United States Patent [19]

Ploeger

[11] 4,191,482

[45] Mar. 4, 1980

[54] PRINTING RIBBON PACKAGE HAVING INK ABSORBING MEANS

[76] Inventor: Carl W. Ploeger, 1404 Dewey Ave., North Bellmore, N.Y. 11710

[21] Appl. No.: 852,253

[22] Filed: Nov. 17, 1977

[51] Int. Cl.[2] ..... B41J 33/14

[52] U.S. Cl. ..... 400/207; 206/204

[58] Field of Search ..... 400/196, 196.1, 197, 400/201, 202, 202.1, 202.2, 202.3, 202.4, 207, 208, 208.1; 206/204, 225, 389, 393

[56] References Cited

U.S. PATENT DOCUMENTS

| | | | |
|---|---|---|---|
| 1,481,971 | 1/1924 | Whiting | 206/204 X |
| 3,026,209 | 3/1962 | Niblack et al. | 206/204 X |
| 3,074,545 | 1/1963 | Lasher | 400/208 |
| 3,099,350 | 7/1963 | Hammond | 206/204 X |
| 3,128,135 | 4/1964 | Ege | 206/204 X |
| 3,211,503 | 10/1965 | Barnes | 206/204 X |
| 3,294,228 | 12/1966 | Urso et al. | 206/389 X |
| 3,415,358 | 12/1968 | Faller | 206/204 |
| 3,819,026 | 6/1974 | Ploeger et al. | 400/202.1 |
| 3,887,727 | 6/1975 | Ploeger et al. | 400/202.1 X |

*Primary Examiner*—Ernest T. Wright, Jr.
*Attorney, Agent, or Firm*—Seidel, Gonda, Goldhammer & Panitch

[57] ABSTRACT

The printing ribbon package includes an absorbent liner within the package housing in contact with an exposed portion of a pad which in turn communicates with an ink reservoir by way of a wick. The liner absorbs ink discharged from the pad while the spool is in said housing.

10 Claims, 3 Drawing Figures

10
12
14
16
18
18'
19
20
20'
22
22'
23
24
26
28
30
30'
32
34
34'
36
36'
38
3

PRINTING RIBBON PACKAGE HAVING INK ABSORBING MEANS

BACKGROUND

One or more spools containing a printing ribbon of the type involved herein is per se old. For example, see U.S. Pat. No. 3,819,026. Ribbons of the type disclosed in said patent have been blister packaged in a conventional manner and shipped by air freight. When such packaged ribbons are received at the distination, the inside surface of the package is discolored and/or contains a film of ink. Such packages are unsightly and are rejected by customers as being defective.

After studying all aspects of the manufacture, packaging and shipment of such ribbons, I have concluded that such ribbons are not defective. The spools contain a reservoir of ink. The reservoir of ink is hermetically sealed and can only communicate with the ribbon by way of a pad which is exposed at its outer peripheral portion. I have concluded that during air shipment, the decrease in atmospheric pressure causes the ribbons to bleed. I have found that the problem created by bleeding of the ribbons can be solved as disclosed hereinafter.

SUMMARY OF THE INVENTION

This invention is directed to a printing ribbon package wherein a spool having a hub is provided with an ink printing ribbon wound around the hub. The spool contains an ink reservoir. A flexible pad is supported by the spool in a position for transmitting ink to an edge of the ribbon. A wick extends from the pad to the reservoir.

A means is provided which defines a housing for said spool to facilitate shipping the spool. A means is provided in said housing and in contact with an exposed portion of said pad for absorbing ink discharged from said pad while the spool is disposed within said housing so as to prevent any such discharged ink from contacting one or more walls of said housing.

When packages in accordance with the present invention are shipped air freight, they will bleed in a manner of the prior art as discussed above. However, any such ink discharged from the spool will be absorbed by a liner while the package is airborne. As soon as the package is returned to ground level, there is a reverse flow from the liner to the pad and ultimately to the reservoir. Hence, when the package is returned to ground level, the liner is slightly discolored but dry.

It is an object of the present invention to provide a printing ribbon package which prevents discoloration or an ink film on the inside surface of the housing when such package is shipped on an air plane.

It is another object of the present invention to provide a solution to the problem created by ribbons bleeding when shipped by air plane and in a manner which is simple, reliable and inexpensive.

Other objects will appear hereinafter.

For the purpose of illustrating the invention, there is shown in the drawing a form which is presently preferred; it being understood, however, that this invention is not limited to the precise arrangements and instrumentalities shown.

Referring to the drawing in detail, wherein like numerals indicate like elements, there is shown in FIG. 1 a printing ribbon package in accordance with the present invention designated generally as 10.

Figures 1, 2, 3:
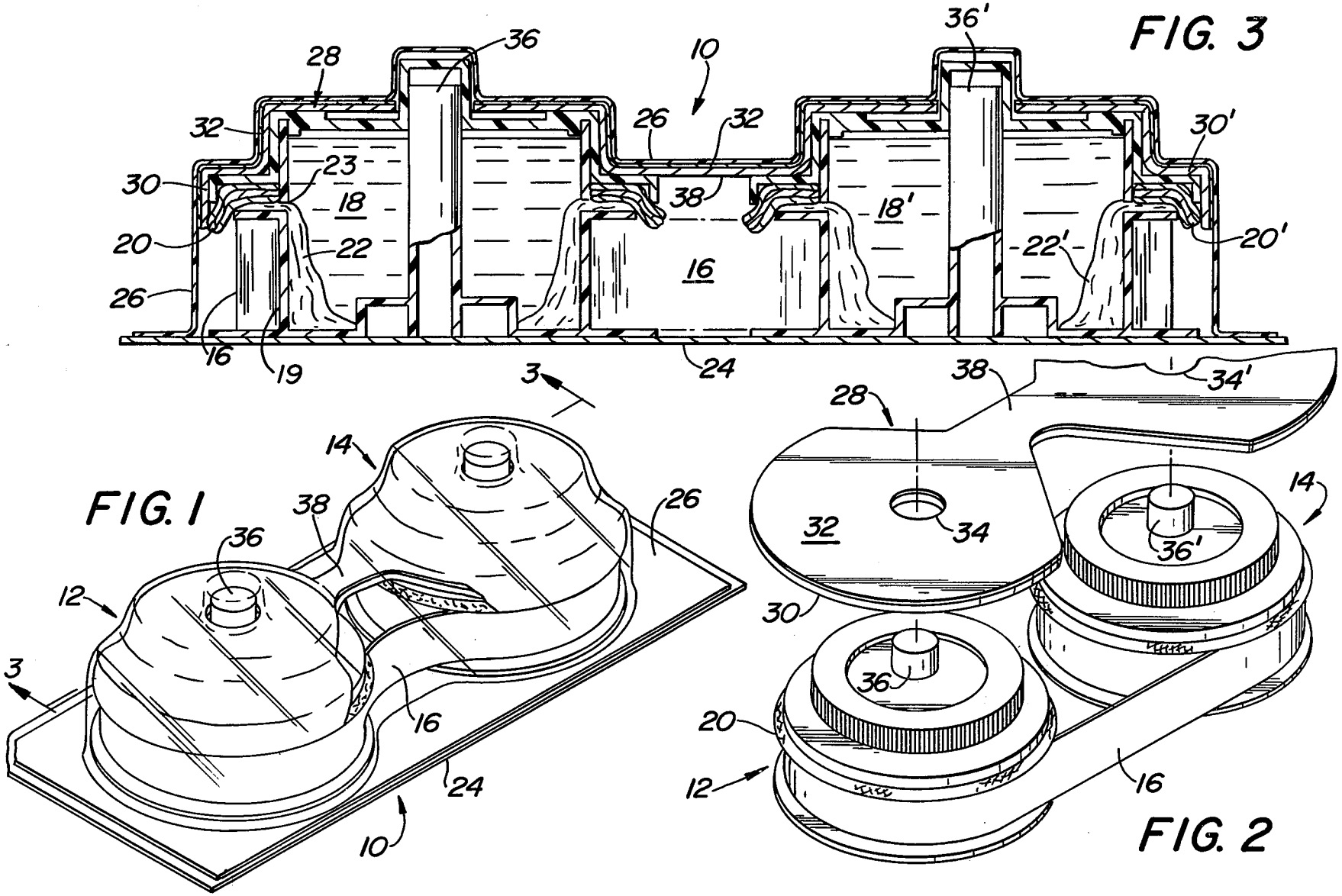
FIG. 1 is a perspective view of a printing ribbon package in accordance with the present invention.
FIG. 2 is an exploded view of two spools and a liner for such spools.
FIG. 3 is a sectional view taken along the line 3—3 in FIG. 1 but on an enlarged scale.

The package 10 contains one or more printing ribbons such as the printing ribbon disclosed in the abovementioned patent. As illustrated, the package includes spools 12 and 14 each having a hub 19 around which there is wound a portion of a printing ribbon 16.

When the package 10 includes two spools such as spools 12 and 14, the spools are identical. Hence, only spool 12 will be described in detail with corresponding primed numerals being provided for the spool 14.

The spool 12 includes a housing having a centrally disposed, hermetically sealed reservoir 18 of ink radially inwardly from the hub 19 of the housing. A deformable pad 20 is supported by the housing of spool 12 immediately adjacent to the hub 19 with an outer peripheral portion of the pad 20 being exposed for contact with the side edge of the ribbon 16 so that ink may be transmitted to a side edge portion of the ribbon 16 as it is wound and unwound from the spool hub 19. A wick 22 extends from the reservoir 18 through a constriction 23 to the pad 20 in the manner as described in the abovementioned patent. The pad 20 is preferably a layer of double knit fabric having a backing of foam polymeric plastic material. Other materials may be utilized for the pad 20. Wick 22 is preferably a strip of knitted or woven fabric.

The spools 12 and 14 with the ink ribbon 16 wound therearound, as shown in FIG. 2, is placed on a base 24. Base 24 may be a conventional layer of paper material having printing on one side and having its other side treated in a conventional manner so that it may be bonded to a blister 26 of polymeric, plastic material which is preferably transparent. The blister 26 is applied by use of conventional equipment so as to have a flange overlying and bonded to the treated side of base 24 while conforming to the shape of the spools 12 and 14.

A liner 28 is provided within the housing defined by base 24 and blister 26. The liner 28 includes an absorbent layer 30 and a shield layer 32 which are generally cicular in configuration for overlying the spool 12. A similar portion of the liner 28 is provided for overlying the spool 14 with the circular portions of the liner 28 being interconnected by a web 38.

The absorbent layer 30 may be a layer of felt, a layer of woven or knitted fabric, etc. The shield layer 32 may be a layer of aluminum foil, a film of polymer plastic material, etc. which is preferably adhesively bonded to the absorbent layer 30.

The liner 28 is of sufficient dimensions so that the absorbent layer 30 is in contact with an exposed portion of the pads 20, 20'. See FIG. 3. The shield layer 32 is disposed between the layer 30 and the inner surface of the blister 26. When the spools 12 and 14 have a centrally disposed boss such as bosses 36 and 36' respectively, the liner 28 will be provided with holes 34, 34' through which such bosses 36, 36' respectively may extend. Thus, the holes 34, 34' facilitate the ability of the liner 28 to conform to the shape of the upper end of the spools 12 and 14.

I believe that the reason why the spools 12 and 14 bleed when being shipped by airplane is due to the fact that the spools 12 and 14, while in an air plane, are exposed to a surrounding atmospheric pressure of about 12–13 psi which is less than the pressure in reservoir 18. While the spools 12 and 14 are on the airplane, the ink is exposed to two different pressures. Hence, the ink flows from the relatively high pressure area in reservoir 18 to the surrounding low pressure area within package 10.

With the liner 28, the ink in reservoir 18 is still exposed to two different pressures when being shipped on an airplane. Hence, the spools 12 and 14 bleed in the manner as described above in connection with prior art ribbons. However, the absorbent layer 30 of the liner 28 is in contact with the exposed portion of the pads 20, 20' whereby layer 30 absorbs any ink which bleeds from the spools 12 and 14. When the package 10 is returned to ground level, the layer 30 is surprisingly dry but indicates evidence of having been exposed to contact with ink. Hence, it is believed that the ink absorbed by the layer 30 is returned to the reservoir 18 by the same law of physics that liquids and gases will flow from a high pressure zone to a low pressure zone.

The pressure within reservoir 18 is preferably about 14–14.6 psi so as to be slightly less than 14.7 psi which is atmospheric pressure at ground level. This feature is attained by having the ink at an elevated temperature such as 150° F. when introduced into the reservoir 18. The ink contracts as it cools to room temperature. Hence, at ground level and with ribbon 16 stationary, there is a tendency for ink to flow toward the reservoir 18 while the spools 12 and 14 are within the housing defined by base 24 and blister 26. When the spools 12 and 14 are in use, ink flows by capillary action from the reservoir 18 to the pad 20 as described in the above-mentioned patent.

Thus, it will be seen that by providing the liner 28, I have solved a significant problem in a manner which is simple and inexpensive while producing a surprising result that the liner 28 will be dry when the package 10 is shipped by way of an airplane and returns to ground level. As a result thereof, access may be had to the spools 12 and 14 without requiring a person to contact a soggy ink-laden liner 28 and without the inherent loss of ink from the reservoir 18 as was the occasion with the ribbons of the prior art when shipped by plane.

The present invention may be embodied in other specific forms without departing from the spirit or essential attributes thereof and, accordingly, reference should be made to the appended claims rather than to the foregoing specification as indicating the scope of the invention.

I claim:

1. A printing ribbon package comprising:

(a) at least one spool having a hub, a printing ribbon wound around said hub, said spool containing an ink reservoir, a flexible pad supported by said spool in a position for transmitting ink to an edge of said ribbon, a wick extending from said pad to said reservoir by way of a constriction in the spool, (b) a housing, said spool being disposed within said housing, (c) means in said housing in contact with said exposed portion of said pad for absorbing ink discharged from said pad while said spool is in said housing.

2. A package in accordance with claim 1 wherein said means for absorbing ink is a liner having an absorbent layer and a non-absorbent shield layer, said shield layer being disposed between said absorbent layer and the juxtaposed portion of said housing to prevent ink absorbed by said absorbent layer from contacting the juxtaposed portion of said housing.

3. A package in accordance with claim 2 wherein said juxtaposed portion of said housing is a transparent polymeric plastic material.

4. A package in accordance with claim 2 wherein said liner is generally circular in configuration and overlies the upper end portion of said spool.

5. A package in accordance with claim 1 wherein said housing includes a pair of spools with said printing ribbon being partially wound on each of said spools, each spool having a pad partially exposed, and said means for absorbing ink being in contact with an exposed portion of each pad.

6. A printing ribbon package comprising:

(a) a spool having a reservoir of ink, said spool having a hub positioned radially outwardly from said reservoir, a printing ribbon at least partially wound on said hub, a flexible pad on said spool, a wick extending from said pad to said reservoir, said spool having a constriction substantially smaller than the transverse dimensions of said wick and through which said wick extends, said pad having an exposed peripheral portion, (b) a housing enclosing said spool, (c) a liner in said housing between a portion of said spool and a juxtaposed portion of said housing, said liner including a layer of ink-absorbent material in contact with said exposed portion of said pad.

7. A package in accordance with claim 6 wherein said ink reservoir is at a pressure slightly below atmospheric pressure at sea level.

8. A package in accordance with claim 6 including a pair of spools in said housing, said ribbon being partially wound on each spool, each spool having a reservoir, each spool having a pad, each having an exposed portion, said liner being in contact with an exposed portion of each pad.

9. A method of compensating for problems created by bleeding of ink from packaged printing ribbons comprising the steps of:

(a) introducing into a housing, a spool containing an ink reservoir and having a pad partially exposed to the atmosphere and communicating with the reservoir by way of a wick, (b) providing a liner of absorbent material within the housing and in contact with the exposed portion of the pad, (c) exposing said housing to a pressure below the pressure in said reservoir whereby ink bleeds from said pad to said absorbent material, (d) then causing absorbed ink to flow from said liner to said pad by exposing said housing to an air pressure of 15 psi.

10. A method in accordance with claim 9 including introducing ink into the reservoir while the ink is above ambiant temperature and hermetically sealing the reservoir except for a wick constriction before the ink cools to ambiant temperature.

* * * * *